US005353517A

United States Patent [19]

Weiss

[11] Patent Number: 5,353,517

[45] Date of Patent: Oct. 11, 1994

[54] PROCESS OF DRYING WATER-CONTAINING SOLIDS IN A FLUIDIZED BED

[75] Inventor: Hans-Jurgen Weiss, Oberursel, Fed. Rep. of Germany

[73] Assignee: Metallgesellschaft Aktiengesellschaft, Frankfurt am Main, Fed. Rep. of Germany

[21] Appl. No.: 78,372

[22] Filed: Jun. 17, 1993

[30] Foreign Application Priority Data

Jun. 26, 1992 [DE] Fed. Rep. of Germany ..... 4220953

[51] Int. Cl.[5] ..... F26B 3/08

[52] U.S. Cl. ..... 34/363; 34/74; 34/469

[58] Field of Search ..... 34/75, 73, 72, 57 A, 34/57 R, 10, 32, 26; 210/771, 770

[56] References Cited

U.S. PATENT DOCUMENTS

| | | | |
|---|---|---|---|
| 2,467,435 | 4/1949 | Langhurst | 34/75 X |
| 2,813,823 | 10/1957 | Putman | 34/75 X |
| 3,212,197 | 10/1965 | Crawford | 34/75 X |
| 3,258,846 | 7/1966 | Powell, Jr. . | |
| 3,654,705 | 4/1972 | Smith et al. . | |
| 4,171,243 | 10/1979 | Brooks et al. . | |
| 4,295,281 | 10/1981 | Potter . | |
| 4,715,965 | 12/1987 | Sigerson et al. . | |
| 5,230,167 | 7/1993 | LaHoda et al. | 34/75 |

FOREIGN PATENT DOCUMENTS

| | | |
|---|---|---|
| 0203059 | 11/1986 | European Pat. Off. . |
| 2837309 | 3/1980 | Fed. Rep. of Germany . |
| 3017778 | 11/1980 | Fed. Rep. of Germany . |
| 3644806 | 5/1988 | Fed. Rep. of Germany . |
| 3943366 | 10/1990 | Fed. Rep. of Germany . |

*Primary Examiner*—Henry A. Bennett
*Attorney, Agent, or Firm*—Sprung Horn Kramer & Woods

[57] ABSTRACT

Water-containing solids are dried in a fluidized bed, which is indirectly heated by at least one heat exchanger. Water vapors having a high water vapor content are withdrawn from the fluidized bed and a part of the vapors is passed as a fluidizing fluid through the fluidized bed. The remaining vapors are cooled to form an aqueous condensate. At least part of the aqueous condensate is contacted in a purification zone with a gaseous or vaporous stripping fluid. Purified condensate and contaminated stripping fluid are separately withdrawn from the purification zone. Water vapor is preferably used as a stripping fluid in the purification zone.

10 Claims, 1 Drawing Sheet

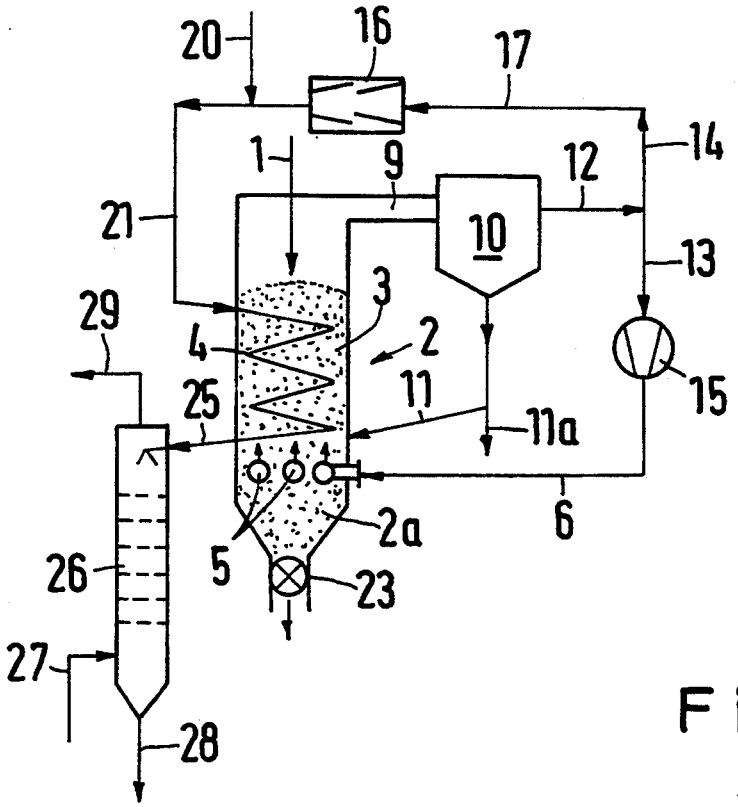
Fig.1
Fig.2
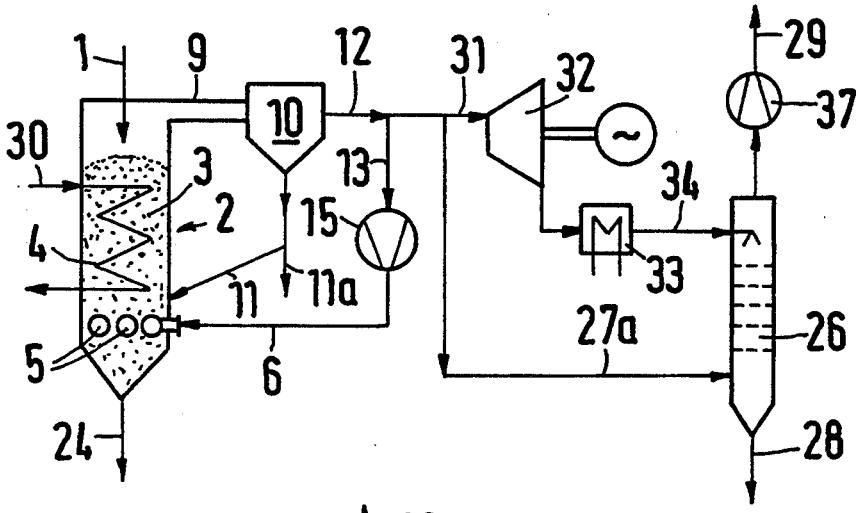
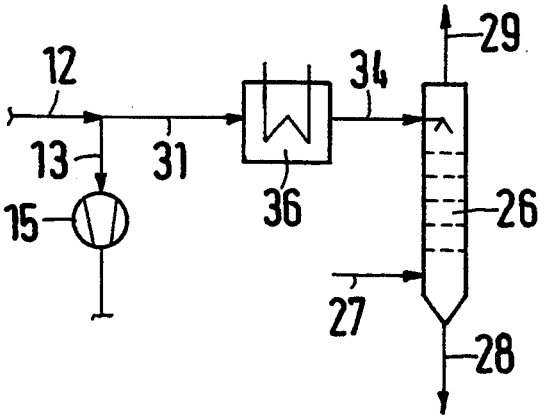
Fig.3

PROCESS OF DRYING WATER-CONTAINING SOLIDS IN A FLUIDIZED BED

DESCRIPTION

This invention relates to a process of drying water-containing solids in a fluidized bed, which is indirectly heated by heat exchange means and from which vapors having a high content of water vapor are withdrawn, wherein part of said vapors are passed as a fluidizing fluid through the fluidizing bed and the reminder or another part of said vapors are cooled to form an aqueous condensate. The solids to be dried may consist, e.g., of coal, brown coal, peat, water-containing waste material or sludge.

A process of that kind has been described in German Patent 29 01 723, in the corresponding U.S. Pat. No. 4,295,281 and in German Patent 36 44 806 and Published German Patent Application 39 43 366. Said processes necessarily result in the formation of an aqueous condensate which contains certain impurities and, for such reason, cannot directly be discharged into the receiving water associated with a sewage system.

It is an object of the invention to effect a sufficient purification in a simple and effective manner of the aqueous condensate formed in the process just described. This is accomplished in accordance with the invention in that at least a part of the aqueous condensate is directly contacted in a purification zone with a gaseous or vaporous stripping fluid and partly purified condensate and contaminated stripping fluid are separately withdrawn from the purification zone.

The process by which the aqueous condensate is purified in accordance with the invention can be carried out in various ways. Water vapor is suitably employed as a stripping fluid. In that case it may be recommendable to feed the condensate to the purification zone at a temperature that is 0° to 10° C. below its boiling temperature so that the rate of the water vapor used as a stripping fluid can be minimized and can be kept, e.g., in a range from 1 to 10% weight of the amount of condensate.

To ensure that the aqueous condensate will be close to its boiling temperature as it enters the purification zone, it may be desirable to pressure-relieve the hot condensate into the purification zone so that the boiling temperature which corresponds to the lower pressure will automatically be assumed and the condensate will partly be evaporated and will thus partly be stripped.

According to a further feature of the process the water vapor used as a stripping fluid is generated in the purification zone in that aqueous condensate is reboiled and evaporated in the purification zone.

The vapor may be condensed in the drying process under a superatmospheric pressure (e.g., of 1.5 to 10 bars) as is described in German Patent 36 44 806. Alternatively, the aqueous condensate to be purified may be formed outside the drying process approximately under atmospheric pressure (i.e., under the pressure under which the vapors leave the fluidized bed) or under a pressure of 0.01 to 0.5 bar, e.g., after a pressure relief effected in a condensing turbine.

Further features of the process will be explained with reference to the drawing, in which FIG. 1 is a flow scheme illustrating a first embodiment of the process, FIG. 2 is a flow scheme illustrating a second embodiment of the process, and FIG. 3 illustrates a modification of the process of FIG. 2.

According to FIG. 1 the water-containing solids to be dried are supplied through line 1 to a vessel 2, which contains a fluidized bed 3. Heat exchange means 4 are provided within the fluidized bed 3 and are flown through by a heating fluid. A fluidizing fluid is supplied through pipes 5, which constitute a grate formed with orifices. The fluidizing fluid is supplied in line 6 and consists of a part of the vapors which have been formed by the drying of the solids in the fluidized bed 3 and have a high water content.

Solids-containing vapors leave the fluidized bed 3 through the duct 9 and first enter dedusting means 10, such as an electrostatic precipitator or bag filter. The solids collected by said dedusting means are recycled in line 11 to the fluidized bed 3 or are withdrawn through line 11*a*. Substantially dust-free vapors leave the dedusting means 10 through line 12 and are distributed to lines 13 and 14. The vapors conducted in line 13 are recycled by a fan 15 and through the line 6 as a fluidizing fluid to the vessel 2.

It is recommendable to utilize the heat content of the remaining vapors, which are conducted in line 14. In the process illustrated in FIG. 1 said vapors are supplied in line 17 to a compressor 16, which is preferably a multi-stage compressor. Water is injected through line 20 to establish saturated-steam conditions in the compressed vapors in line 21. Said compressed vapors are used as a heating fluid and are supplied through line 21 to the heat exchange means 4. The vapors flowing through the heat exchange means condense therein at least in part and the heat of condensation which is recovered is used as an effective source of energy for an indirect heating of the fluidized bed 3. Substantially dry solids slide down between the tubes 5 into the collecting chamber 2*a* of the vessel 2 and are withdrawn through the metering means 23.

The aqueous condensate which leaves the heat exchange means 4 through line 25 contains various impurities. To effect an at least partial purification of that condensate, it is supplied to a stripping column 26, which contains, e.g., plates or packing elements. A gaseous or vaporous stripping fluid is supplied through line 27 into the lower portion of the column 26. The use of water vapor as a stripping fluid will be recommendable if the condensate supplied to the column 26 through line 25 is at a temperature which is 0° to 10° C. and preferably not more than 5° C. below its boiling temperature. As a result, only a small part of the water vapor used as a stripping fluid is consumed in the column 26 by being condensed in the column 26.

As an alternative to the use of water vapor from an extraneous source as a stripping fluid, the water vapor may be generated in that the aqueous condensate is reboiled by indirect heating. The condensate may be reboiled and evaporated, e.g., in the lower portion of the stripping column 26 or outside the same.

Substantially purified condensate leaves the column 26 in line 28 and may be discharged, e.g., into a body of water. The contaminated stripping fluid is withdrawn in line 29 from the top of the column 26 and is disposed of, e.g., by a thermal processing, particularly in an incinerating plant. Alternatively, the stripping fluid withdrawn through line 29 may be purified by being contacted with activated coal or activated coke. If water vapor has been used as a stripping fluid, the purified water vapor can be reused in the drying process, e.g., as a fluidizing fluid. Alternatively, the contaminated stripping fluid may be condensed and the resulting condensate may be disposed of by being distributed over the dried solids.

FIG. 2 again shows the vessel 2, which contains the fluidized bed 3 and the heat exchange means 4 and is used to dry the water-containing solids supplied in line 1. Low-water solids are withdrawn in line 24. The explanations given in connection with FIG. 1 are applicable also to those items which are designated with the same reference numbers. In this case the heating fluid supplied to the heat exchange means through line 30 consists of steam from an extraneous source or heat transfer oil rather than of compressed vapors. Dedusted vapors are conducted in line 31 to an expander turbine 32, which is succeeded by a condenser 33. The turbine 32 is preferably used to generate electric power. The condensate withdrawn from the condenser 33 is supplied in line 34 to the stripping column 26, which is supplied through line 27*a* with a stripping fluid, preferably water vapor. That stripping fluid may consist of a partial stream of the vapors which have been dedusted. At least partly purified condensate is withdrawn from the column 26 in line 28 and contaminated stripping fluid is withdrawn in line 29 by a vacuum pump 37.

FIG. 3 illustrates a modification of the process of FIG. 2. The column 26 is operated under a near-atmospheric pressure. In accordance with FIG. 3 the dedusted vapors from lines 12 and 31 are supplied to condensing means 36 and the heat of condensation which has been recovered may be utilized for any desired purpose. The aqueous condensate flows from the condenser 38 in line 34 to the stripping column 26, in which the condensate is purified and which is supplied in line 27 with stripping fluid, such as water vapor.

EXAMPLE

A fluidized bed dryer 2 as shown in FIG. 2 is supplied through line 1 at a rate of 100,000 kg/h with brown coal having particle sizes below about 8 mm and having an initial moisture content of 62.3% by weight. The heating fluid consists of saturated steam, which is at a temperature of 160° C. and under a pressure of 6 bars and is supplied at a rate of 73,500 kg/h through line 30 to the heat exchange means 4, in which the steam condenses. As a result, the heat required for drying is transferred to the fluidized bed 3, which is heated to about 105° C.

Dry brown coal having a residual moisture content of 14% by weight is withdrawn from the dryer in line 24 at a rate of 43,800 kg/h, and vapors are withdrawn from the dryer at a rate of 155,600 kg/h through the duct 9. The vapors are dedusted in the electrostatic precipitator 10 and a partial stream of the vapors at a rate of 99,400 kg/h is recycled via line 13, fan 15, and line 6 as fluidizing steam into the fluidized bed dryer. As is shown in FIG. 3 the remaining vapors, at a rate of 56,200 kg/h, are supplied in line 31 to condensing means 36, in which the vapors are condensed at about 100° C. and caused to deliver their heat of condensation.

The condensate flowing in line 34 has a chemical oxygen demand (COD) of about 110 mg $O_2$ per liter. In the stripping column 26 having 12 plates the condensate is stripped with low-pressure saturated steam, which is supplied from line 27 at a rate of 1000 kg/h, and the condensate is thus purified to a COD of 500 mg $O_2$ per liter and can now be discharged into a body of water. Contaminated stripping vapor at a rate of 1000 kg/h is withdrawn from the column through line 29 and has a COD of 3.37 g $O_2$ per liter. This contaminated stripping vapor is incinerated.

There has thus been shown and described a novel process of drying water-containing solids in a fluidized bed which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

I claim:

1. A method of drying water-containing solids in a fluidized bed, including the steps of indirectly heating the bed by heat exchange means and withdrawing from the bed vapors having a high content of water vapor, passing part of said vapors as a fluidizing fluid through the fluidizing bed and cooling the remainder or another part of said vapors to form an aqueous condensate, directly contacting at least a part of the aqueous condensate in a purification zone with a gaseous or vaporous tripping fluid, and separately withdrawing from said purification zone partly purified condensate and contaminated stripping fluid.

2. A process according to claim 1, wherein the stripping fluid in the purification zone comprises water vapor.

3. A process according to claim 1, wherein aqueous condensate is reboiled and evaporated in the purification zone to generate aqueous stripping fluid.

4. A process according to claim 1, wherein the aqueous condensate is supplied to the purification zone at a temperature which is 0° to 10° C. below the boiling temperature.

5. A process according to claim 2, wherein water vapor is supplied to the purification zone at a rate which is 1 to 20 weight % of the amount of the condensate.

6. A process according to 5, wherein the aqueous condensate is pressure-relieved into the purification zone.

7. A process according to claim 1, wherein the contaminated stripping fluid withdrawn from the purification zone is subjected to a thermal processing.

8. A process according to claim 1, wherein the contaminated stripping fluid withdrawn from the purification zone is purified in contact with activated coal or activated coke.

9. A process according to claim 1, wherein the contaminated stripping fluid withdrawn from the purification zone is condensed and the resulting condensate is admixed with the dried solids.

10. A process according to claim 8, wherein the stripping fluid purified in contact with activated coal or activated coke consists of water vapor and is supplied to the drying process.

* * * * *